United States Patent [19]

Clayton et al.

[11] 3,972,654

[45] Aug. 3, 1976

[54] DIAPHRAGM PUMP BOILER FEED WATER SYSTEM

[75] Inventors: William Clayton, Pasadena; George W. Mattox, El Monte, both of Calif.

[73] Assignee: Clayton Manufacturing Company, El Monte, Calif.

[22] Filed: May 20, 1974

[21] Appl. No.: 471,242

[52] U.S. Cl. ..... 417/388; 417/395; 122/451 R; 92/99

[51] Int. Cl.[2] ..... F04B 9/08; F04B 43/06; F22D 5/26

[58] Field of Search ..... 417/338, 390, 395, 353, 417/384; 122/451 R; 60/468; 92/98, 98 R, 104

[56] References Cited

UNITED STATES PATENTS

| | | | |
|---|---|---|---|
| 121,748 | 12/1871 | Blessing | 417/395 |
| 1,926,208 | 9/1933 | Mantle | 417/395 |
| 2,111,964 | 3/1938 | Crane | 60/468 |
| 2,732,127 | 1/1956 | Booth | 417/395 |
| 3,030,892 | 4/1962 | Piccardo | 417/384 X |
| 3,260,245 | 7/1966 | Telford | 122/451 R |
| 3,276,673 | 10/1966 | Jones | 417/46 X |
| 3,304,870 | 2/1967 | Growell et al. | 417/388 |
| 3,357,360 | 12/1967 | Borell | 417/395 |
| 3,494,294 | 2/1970 | Hetz | 417/387 |
| 3,791,768 | 2/1974 | Wanner | 417/395 |

*Primary Examiner*—Carlton R. Croyle
*Assistant Examiner*—Richard E. Gluck
*Attorney, Agent, or Firm*—Jackson & Jones

[57] ABSTRACT

A hydraulic fluid control system regulates the delivery rate of feed water to a boiler. A hydraulic actuated diaphragm pump having a plurality of diaphragm working chambers which are interconnected with check valve controlled inlets and outlets pumps the feed water to the boiler. Fluid surges or pulsations are prevented by the use of projection members on the face of the diaphragms and by a variably controlled pressure regulator responsive to the feed water pressure. The delivery rate of hydraulic fluid to the diaphragms controls the actual pumping output. A bypass line including a pressure regulating valve with pilot control and a modulating control valve controls a bypass hydraulic fluid rate which directly corresponds to the pumping output rate.

28 Claims, 4 Drawing Figures

FIG. 3
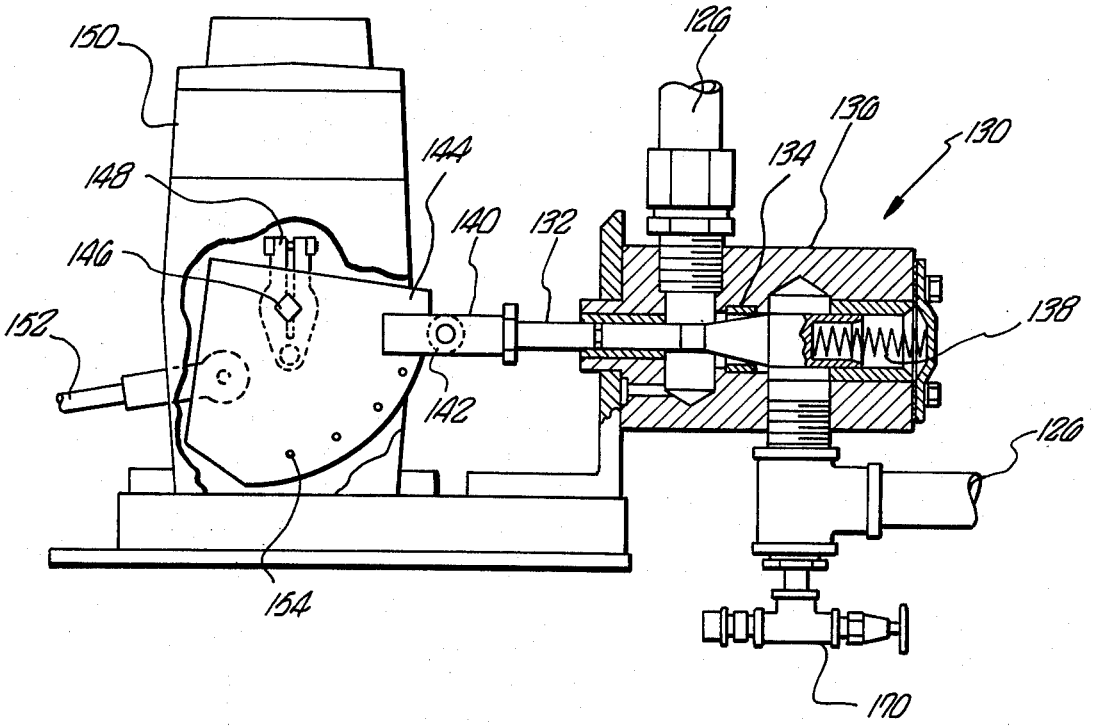
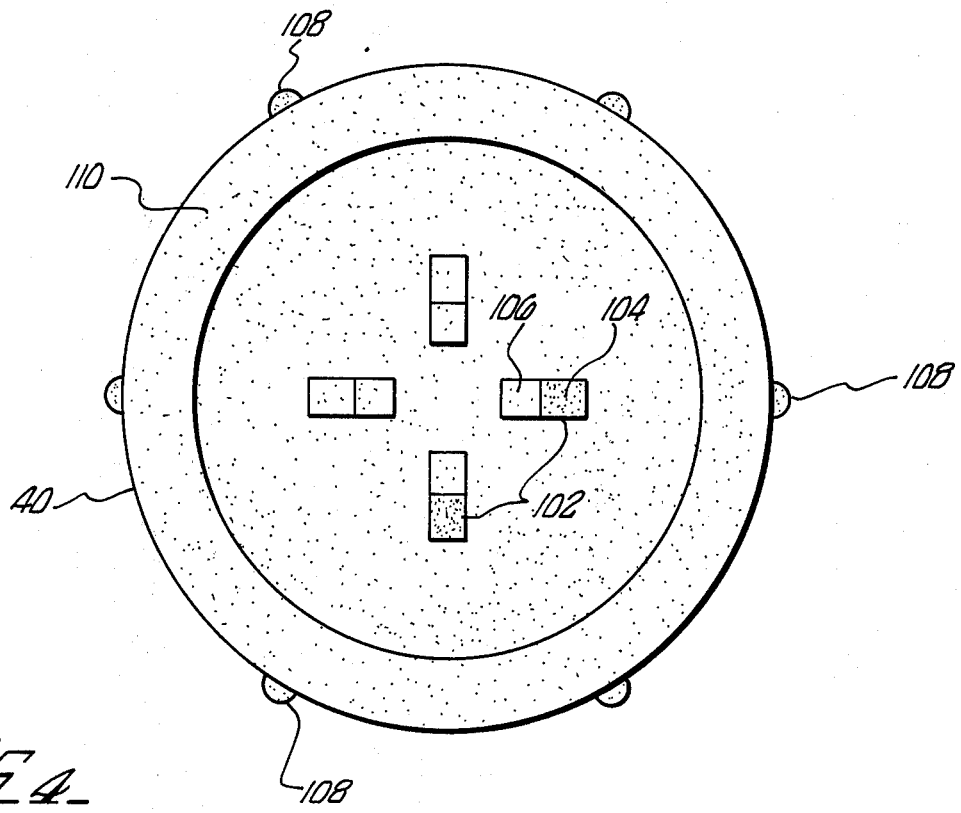
FIG. 4

DIAPHRAGM PUMP BOILER FEED WATER SYSTEM

BACKGROUND OF THE INVENTION

1. Field of the Invention

The present invention relates to a hydraulically actuated and controlled diaphragm pump in a boiler feed water pumping system. More particularly, the invention is directed to a relatively vibration free diaphragm pump whose rate of pumping can be controlled to vary the amount of feed water delivered to a boiler or steam generator.

2. Description of the Prior Art

The prior art has utilized various forms of hydraulic fluid systems for supplying and controlling hydraulic fluid under pressure to hydraulic motors which drive pistons or plungers in a pump mechanism. For example, positive displacement pumps have been widely used when it is desired to move a large volume of fluid at a relatively high pressure. Diaphragm proportioning pumps have been utilized generally in applications which require the pumping of fluids at accurately controlled rates. A frequent problem in both forms of pumps has been the effects of surging or pressure pulsations which are capable of creating destructive vibrations which produce noise and tend to induce destructive stresses in the pump. The pressure surges generally develop from the increase of velocity imparted to the fluid by the sudden releasing or movement of the fluid in the system.

In the field of boiler steam generators having, for example, a 10 million BTU output per hour with a steam operating pressure of 65 to 350 psi, a diaphragm type of water pump has been utilized driven by an electric motor. The electric motor drives reciprocating pistons within the pump housing which, in turn, drive the diaphragms hydraulically by the oil displaced by the reciprocating pistons. One section of the pump can be stopped by bypassing the oil through a solenoid bypass valve thereby controlling the pump output. Tubular water columns can separate the check valve housings from the pump heads to keep excessive temperature from the diaphragms. Snubbers absorb pressure pulsations to insure a stabilized pump delivery. The amount of water delivered to the coil of the steam generator is actually regulated by a water bypass valve capable of returning a portion of the water to the pump inlet. An appropriate water bypass pressure regulator can maintain a constant pressure at the bypass valve inlet to assure constant flow characteristics through the valve to control the flow rate.

The patent literature contains numerous examples of diaphragm pumps such as the Hetz U.S. Pat. No. 3,494,294, Booth U.S. Pat. No. 2,732,127, Bowman U.S. Pat. No. 2,593,255, Carver U.S. Pat. No. 2,948,221, and Schmidt U.S. Pat. No. 2,646,000. Likewise, numerous patents have been granted for various forms of pumping systems such as Jackson U.S. Pat. No. 3,405,654, Telford U.S. Pat. No. 3,260,245 Carr Jr., et al U.S. Pat. No. 3,101,058 and Krute U.S. Pat. No. 3,022,738. Many of these prior art patents are directed to diaphragm pumps and feed water systems for special requirements that are relatively expensive. There is still a demand for a relatively inexpensive, durable, vibration free diaphragm pump for use in feed water supply systems to boilers and the like.

SUMMARY OF THE INVENTION

The present invention is directed to a hydraulically actuated diaphragm pump and feed water supply system which includes a source of hydraulic fluid that is pressurized, for example, by a constant flow pump. The diaphragm pumping apparatus is driven by the hydraulic fluid and is adapted to be connected to the boiler and a source of water. Means are provided for reducing any pressure surging of the hydraulic fluid and the boiler feed water including a diaphragm having a surface configuration that prevents the diaphragm from sealing against the cavity wall of an actuating chamber. Further, means can be provided for varying the pressure of the exhausting hydraulic fluid from the actuating chambers of the diaphragm pump in response to variations of the water source pressure.

Finally, means can be provided for varying the rate of hydraulic fluid delivered to the pumping apparatus by bypassing a portion of the hydraulic fluid before it reaches the diaphragm pump actuating chamber.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE DRAWINGS

FIG. 3 is a partial cross section of the hydraulic modulating control valve; and FIG. 4 is a plan view of the diaphragm.

DESCRIPTION OF THE PREFERRED EMBODIMENT

The present invention is directed to a hydraulically actuated diaphragm pump that forms an internal part of a hydraulic control system for delivering boiler feed water. The present invention provides a relatively precise flow output from a feedwater pump regardless of the condition of the boiler feedwater. The present invention is particularly adapted to meet the requirements of a high pressure boiler system in an effective and economical manner.

Figure 1:
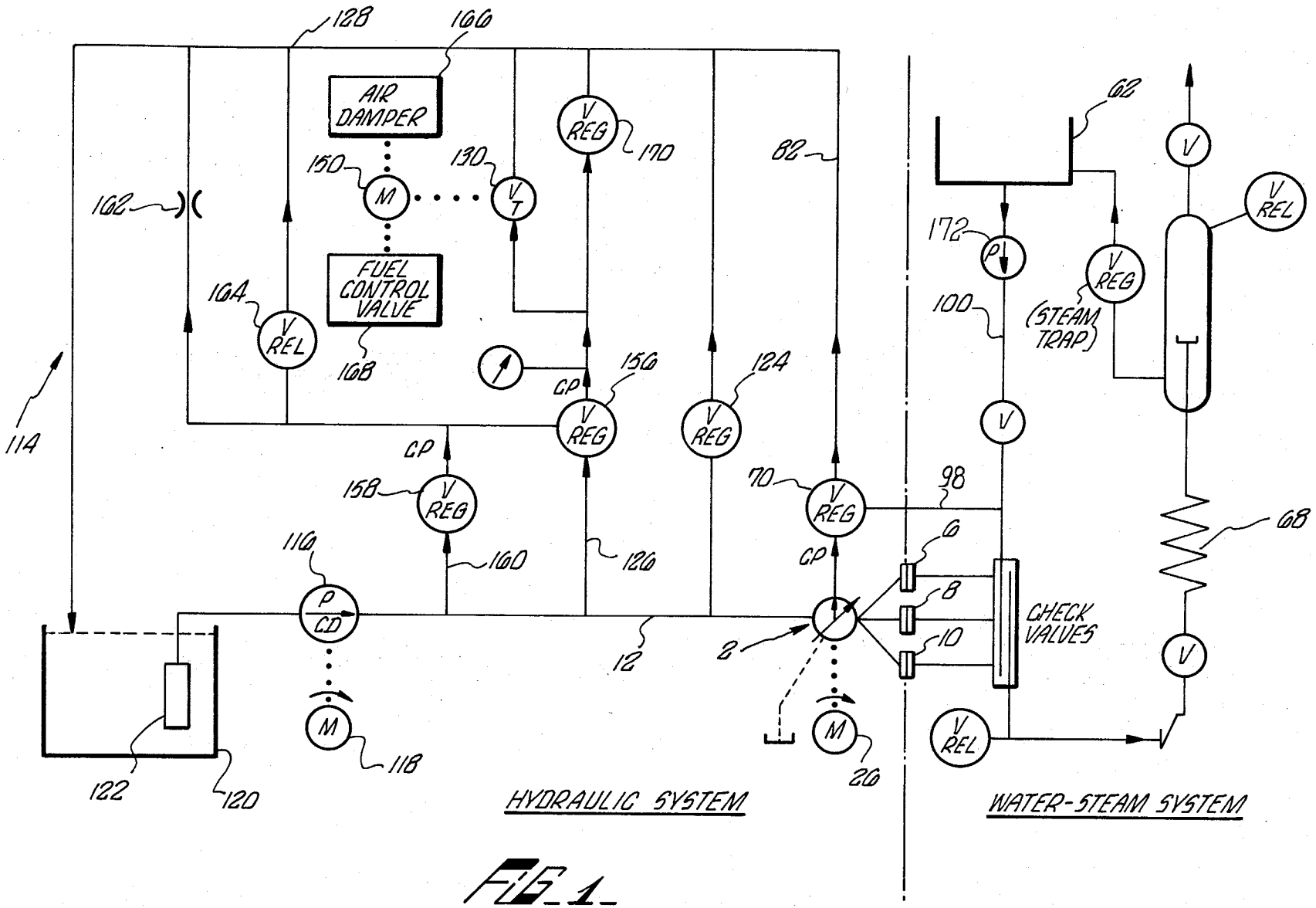
FIG. 1 is a schematic of the hydraulic control system.
Figure 2:
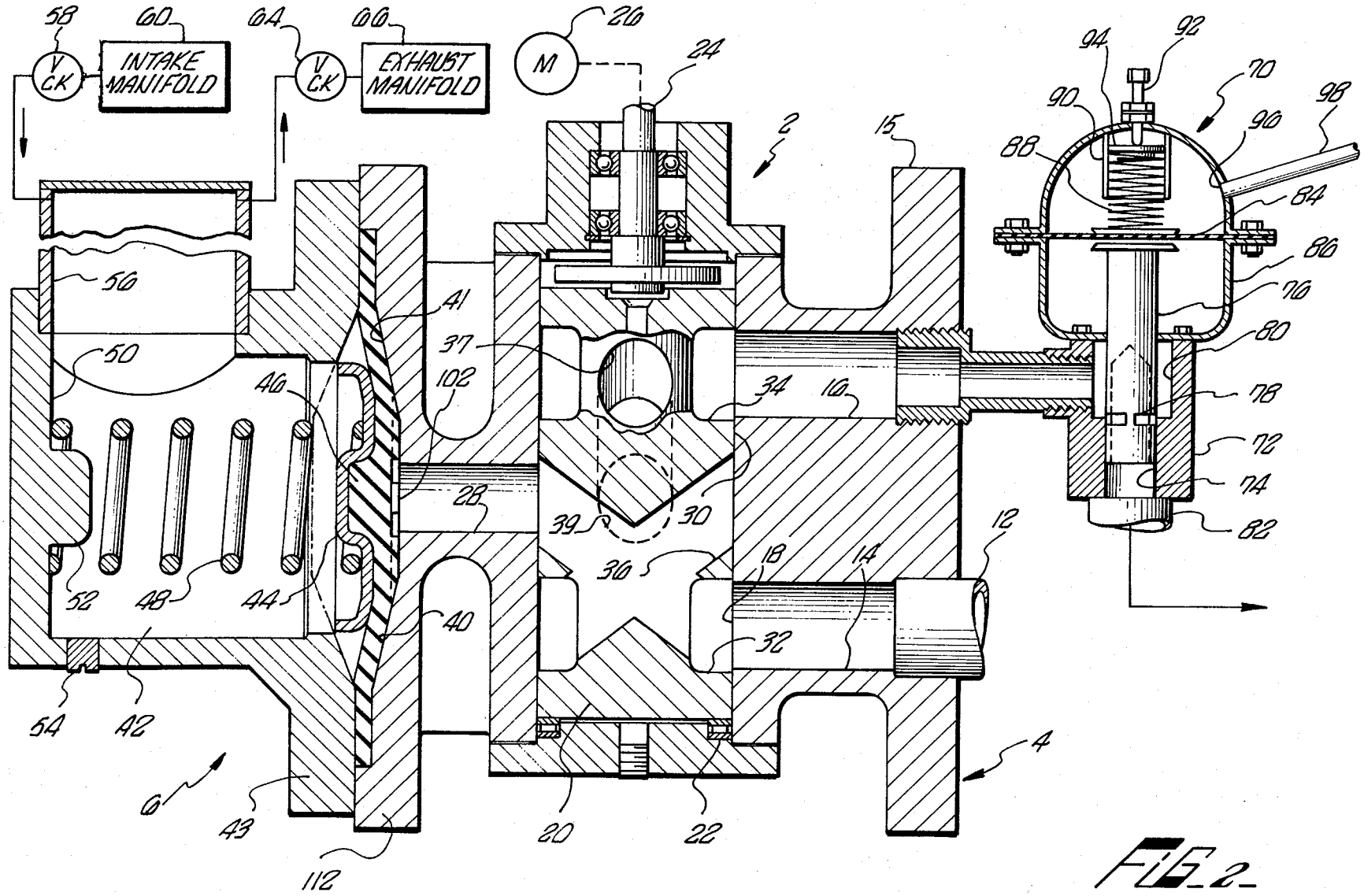
FIG. 2 is a cross section of the diaphragm pump.

Referring to FIG. 2, a hydraulically actuated diaphragm pump 2 is disclosed in a cross sectional view. The pump housing 4 can consist of a number of individual components that are bolted or welded together such as the flange member 112 and the head member 43. A plurality of diaphragm pump assemblies are actually mounted in a spaced-apart relationship around the lower portion of the pump housing 4. FIG. 2 only discloses a cross sectional view of one diaphragm pump assembly 6 but it should be understood that a plurality of diaphragm pump assemblies 6, 8 and 10 are actually utilized on an operational pump 2. As can be seen in FIG. 1, the preferred embodiment utilizes three diaphragm pump assemblies 6, 8 and 10; these pump assemblies can be positioned approximately 120° apart. This arrangement assures a relatively smooth discharge flow rate since the individual fluid output pulses are in a phased relationship.

Referring again to the disclosure of FIG. 2, a hydraulic feed line 12 is connected to a pump housing intake conduit 14 formed in another pump housing flange member 15. The intake conduit 14 is positioned parallel to an exhaust conduit 16 in the flange member 15 of the housing 4. Both conduits provide fluid communication with a transversely aligned vertical cylindrical bore member 18. The bore member 18 is adapted to rotatably support a distributor or spool valve 20 and communicates with the intake and exhaust conduits.

At the bottom of the cylindrical bore member 18, a thrust bearing 22 is mounted between the housing 4 and the distributor valve 20 to support the relative rotation of the valve 20. A drive shaft 24 is connected to the distributor valve 20 and also to a source of power such as an electrical gear motor 26 for rotating the valve 20, preferably at a constant speed.

A plurality of annular channels or conduits 28 are provided at spaced apart intervals along the inner peripheral surface of the cylindrical bore member 18 to communicate respectively with each of the diaphragm pump assemblies such as diaphragm pump assembly 6. The conduits are cast in the flange member 112 of the pump housing 4. The distributor spool valve 20 comprises a central annular land portion 30 having respective annular grooves 32 and 34 on either side of the land portion. The annular grooves provide hydraulic balancing of the distributor spool valve 20 with regards to the hydraulic fluid passing to and from the pump diaphragm assemblies. Annular groove 32 is connected to the intake conduit 14 while annular groove 34 is connected to the exhaust conduit 16. In the illustrated embodiment, four transfer fluid passageways 36 are drilled through the distributor valve 20. Two fluid passageways 36 extend linearly from the intake annular groove 32 inward at approximately 53° to the longitudinal axis of the distributor spool valve 20 to terminate on the surface of the land portion 30. The respective axis of each fluid passageway 36 is positioned 180° apart from each other about the annular groove 32. These fluid transfer passageways 36 periodically connect the respective diaphragm pump assemblies such as diaphragm pump assembly 6 with the pressurized hydraulic fluid from the hydraulic fluid line 12 as the distributor valve 20 rotates.

Exhaust annular groove 34 is also connected with a pair of fluid transfer passageways 36 communicating in a similar fashion with the land portion 30 but arranged 90° out of phase about the annular land surface with the fluid passageways of the intake annular groove 32. The exhaust transfer fluid passageways 36 likewise terminate on the land portion 30 and serve to respectively interconnect each of the diaphragm pump assemblies with the exhaust conduit 16. The exit port 37 of one of the exhaust transfer fluid passageways 36 is shown in FIG. 2 with the entrance port 39 on land portion 30 disclosed in phantom lines.

The fluid conduit 28 terminates in an actuating chamber 38 of the diaphragm pump assembly 6 in head 43. The actuating chamber cavity is actually formed or completed by the diaphragm 40 as shown in FIG. 4 to be discussed subsequently. The cavity wall 41 of the flange 112 opposite the diaphragm 40 has a beveled side surface that terminates in a central flat disk portion adjacent the port entrance of the conduit 28. A pumping or working chamber 42 is formed in the head 43 on the other side of the diaphragm 40. A spring washer 44 is positioned in the working chamber 42 and is adapted to seat on a hub portion 46 of the diaphragm 40. A bias spring 48 seats between the spring washer 44 and an opposite wall 50 of the pumping chamber 42. The wall 50 includes a projecting hub portion 52 for seating the spring 48. The spring 48 is capable of exerting a 25 psi bias pressure across the working surface of the diaphragm 40.

The diaphragm 40 as shown in FIG. 2 is biased by the spring 48 to a closed position wherein the pumping chamber volume is maximized and the actuating chamber volume is minimized. The actual physical displacement or stroke of the diaphragm 40 at its center is approximately one half inch at full output. A drain plug 54 is provided at the bottom of the pumping chamber 42 to remove fluid, for example during maintenance.

Connected directly to the top of the pumping chamber 42 is an elongated tubular column 56 which has sufficient height to maintain a relatively stable column of water which will thermally insulate the diaphragm 40 from the temperature effects of the intake feed water. The feed water can reach elevated temperatures of up to 450°F which could quickly damage the diaphragm 40. The relatively stable or stratified water within the water column 56 permits the diaphragm 40 to operate effectively at a maximum temperature of 160°F and maintain a longer cycle life over its full output rate of approximately 420 CPM. The tubular column 56 can be welded or screwed onto the working chamber housing 43. Frequently, connecting rods or bars are connected adjacent the water column 56 and are placed in tension in order to maintain the water column in a compression state for securement to the pump housing 4. Generally a separate water column 56 will be provided for each of the diaphragm pump assemblies.

Each water column 56 will have an intake check valve 58 connected to a single intake manifold 60 which is, in turn, connected to a water reservoir 62. Generally, the intake manifold 60 will have a toroidal shape to provide a ready connection with the other water columns positioned above their respective diaphragm pump assemblies 8 and 10. An exhaust check valve 64 is connected to a common exhaust manifold 66 which can comprise three exhaust legs (not shown) connected respectively to each diaphragm assembly and converging to a common discharge port for delivering water to the boiler 68. The check valves are only shown schematically in FIG. 1.

Means for regulating the exhausting pressure of the hydraulic fluid from the diaphragm assemblies are connected to the exhaust conduit 16 and include a diaphragm pressure regulator or pressure control valve 70. The purpose of the pressure regulator valve 70 is to help prevent pressure surges or shocks in the hydraulic system. With operating pump pressures of 200 psi and higher existing in the actuating pump chamber 38, the unrestricted exhausting of the hydraulic oil or fluid by the rotating distributor valve 20 can produce excessive vibration, shock and noise. In actual operation, the pump housing 4 would be shaken to a destructive excess if the hydrualic oil was exhausted to atmospheric pressure.

The pressure regulator valve 70 helps control the pressure surges and can further regulate the exhausting oil pressure in proportion to the feed water pressure entering the intake manifold 60. The pressure regulator valve 70 includes a lower housing body 72 having an axial bore 74 connected to an exhaust conduit 82. A hollow valve stem 76 is mounted for reciprocal valving movement within the bore 74. The hollow stem 76 includes a pair of ports 78 that provide fluid communication between the exterior of the stem 76 and the open hollow interior portion of the stem 76. The annular opening of the bore 74 into a manifold chamber 80 provides a porting or valving action for controlling the flow of hydraulic fluid or oil from the chamber 80. The chamber 80 is directly connected to the exhaust conduit 16. The stem 76 extends through the chamber 80 and is connected to the center of a flexible diaphragm 84. The flexible diaphragm 84 is mounted in a top housing member 86 which, in turn, is appropriately connected to the lower housing member 72.

A bias spring 88 is journaled within a tubular sleeve 90 and is connected to the other side of the diaphragm 84 from its connection with the stem 76. The bias spring 88 permits a bias force to be applied to the diaphragm 84. A threaded shaft 92 is capable of moving a spring washer 94 along the tubular sleeve 90. Since the spring washer 94 serves as a seat for the bias spring 88, this particular arrangement permits the bias force applied through the spring 88 against the diaphragm 84 to be adjustable. Thus it is possible to provide a pre-bias force that will position the stem ports 78 in a partially closed or restricted flow position. The force of the oil or hydraulic fluid pressure on the other side of the diaphragm 84 will tend to unblock or open the ports 78 and permit a relatively unrestricted flow of hydraulic fluid to the exhaust line 82. A port 96 in the top housing 86 provides a fluid connection to a pilot conduit 98 which is, in turn, connected to a fluid conduit 100 in the water-steam system for connecting the water reservoir 62 with the intake manifold 60 of the pump 2. Thus, variations in the feed water pressure within conduit 100 are effectively transmitted to one side of the diaphragm 84 and help regulate or proportion the exhausting flow of hydraulic fluid through the ports 78.

Referring to FIG. 4, a plan view of the pump diaphragm 40 is provided. Basically, diaphragm 40 comprises a molded synthetic rubber material internally reinforced with fabric. The face of the diaphragm 40 that contacts the hydraulic oil and forms a portion of the actuating chamber 38 is disclosed in FIG. 4 and includes a plurality of rectangular raised portions or projections 102. Each projection 102 has an inclined or wedge ramp portion 104 which merges into the outer peripheral surface of the diaphragm 40. The inclined ramp 104 terminates adjacent the center of the diaphragm 40 in a square raised flat section 106. The diaphragm projections 102 extend sufficiently from the surface of the diaphragm 40 so that they are capable of contacting the fluid pressure actuating cavity wall 41 to prevent the diaphragm 40 from sealing against the wall 41. Half-moon projections 108 are spaced about the outer periphery of the diaphragm ring portion 110 for the purpose of centering the diaphragm 40 in appropriately machined recessed portions (not shown) on the flange 112 of the pump housing 4.

In operation the feed water diaphragm pump 2 receives pressurized hydraulic fluid such as oil from a constant delivery pump 116 via the hydraulic feed line 12. This pressurized hydraulic fluid is supplied through the intake conduit 14 to the distributor valve 20 which is rotated at a constant speed by the electric motor 26. The fluid passageways 36 that connect intake annular groove 32 to a portion of the land area 30 are capable of periodically aligning with a conduit 28 in the flange portion 112 of the pump housing 44. The illustrated fluid conduit 28 connects with the diaphragm pump assembly 6. A plurality of diaphragm pump assemblies are provided and in the preferred embodiment three of the diaphragm pump assemblies are utilized and are shown in FIG. 1 schematically as the diaphragm pump assemblies 6, 8 and 10.

The flexible pump diaphragm 40 is initially biased closed by the spring 48 mounted in the pumping or working chamber 42. The pumping or working chamber 42 receives a charge of feed water from the hot well reservoir 62 via the line 100 and the intake manifold 60 through the intake check valve 58. A tubular water column 56 provides a relatively stable thermal barrier of feed water between the top of the tubular column 56 and the pump diaphragm 40. When the intake fluid passageways 36 in the distributor valve 20 align with the conduit 28, the hydraulic fluid pressure forces the diaphragm 40 against the bias of the spring 48 for a stroke displacement of approximately one half of an inch. This displacement of the pumping chamber 42 forces a portion of the feed water through the exhaust check valve 64 into the exhaust manifold 66. As the distributor valve 20 rotates 90°, an exhaust fluid passageway 36 having a port opening illustrated as element 39 in FIG. 2 is aligned with the conduit 28. The hydraulic fluid is then discharged from the actuating chamber 38 into the exhaust fluid passageway 36 through the port opening 37 into the exhaust annular groove 34. The exhausting hydraulic fluid is communicated through the exhaust conduit 16 to the pressure regulator valve 70. At the end of the discharge of the hydraulic fluid through the conduit 28 the pump diaphragm 40 is again returned to its closed position by the force of the spring 48 as depicted in FIG. 2.

The projections 102 on the surface of the pump diaphragm 40 that form part of the actuating chamber 38 contact the cavity wall 41 and prevent the pump diaphragm 40 from sealing about the discharge port of the conduit 28. Since diaphragm projections 102 effectively increase that surface area of the diaphragm 40 subject to the initial application of pressurized hydraulic fluid, any sudden creation of hydrdaulic force with resulting shock and vibration is drastically reduced. Thus, there is no sudden "breaking" of the pump diaphragm 40 off of the cavity wall 41 upon the application of hydraulic fluid pressure.

Likewise, the pressure regulator valve 70 prevents any sudden return of the diaphragm 40 by providing a variable fluid back pressure in the exhaust conduit 16. This back pressure further includes a constant predetermined spring force acting upon the valve diaphragm 84 that controls the valve stem 76 in porting the chamber 80 of the valve 70. Superimposed on the constant spring pressure is a variable fluid pressure created by connecting the pilot conduit 98 to the feed water pressure that exists in the intake manifold 60 for proportionately biasing the valve diaphragm 84 in relationship to the feed water pressure to control the rate of the discharging or exhausting hydraulic fluid from the exhaust conduit 16. Thus, the projections 102 on the pump diaphragm 40 help to prevent any surging or pressure shocks on the power stroke of the pump diaphragm 40 while the pressure regulating valve 70 helps to prevent any shocks or vibration on the return stroke of the pump diaphragm 40. As can be appreciated, each of the diaphragms utilized in the diaphragm pump assemblies 6, 8 and 10 contain similar projection members such as that disclosed on pump diaphragm 40. Likewise each of the diaphragm pump assemblies discharge their fluid through the pressure regulator valve 70. Generally, the individual diaphragms when at full output reciprocate at approximately 420 CPM.

Referring to FIG. 1, a schematic of a feed water control system for providing variable water rates to the boiler 68 in a controlled, predetermined fashion and under variable pressure conditions is illustrated. The feed water system is capable of operating with either cold water or hot water of up to 450°F from the hot well water reservoir 62. In addition, water pressures from zero to 500 psi inlet and zero to 1,000 psi outlet from the boiler can be accomplished in this novel boiler feed water pump system.

The feed water is drawn from the hot well water reservoir 62 by a pump 172 and delivered through the line 100 to the check valve assembly. The individual components that comprise the water-steam system are conventional and accordingly need not be described within the context of the present invention.

Basically, the hydraulic control system 114 controls the water pumping rate of the diaphragm pump 2, which for purposes of illustration is only schematically shown in FIG. 1, by controlling the hydraulic fluid or oil delivery rate to the respective diaphragm assemblies 6, 8 and 10. A constant flow pump 116 of a type conventionally available in the prior art is driven by an electric motor 118 to provide a constant flow rate of hydraulic oil regardless of the oil pressure in the hydraulic feed line 12. The constant flow pump 116 draws the oil from an oil reservoir 120 through an appropriate filter 122. A relief valve 124 is connected to the hydraulic feed line 12 that delivers the pressurized hydraulic oil to the distributor valve 20 which, in turn, proportions the oil tc the pumping diaphragm assemblies 6, 8 and 10. The exhausting oil from the diaphragm pump assemblies leaves the distributor valve 20 via exhaust conduit 82.

As mentioned earlier, the hydraulic control system 114 controls the pumping rate of the diaphragm pump 2 and accordingly the feed water rate by controlling the oil flow rate through the hydraulic line 12 to the distributor 20. This is accomplished by a bypass conduit 126 which connects to the hydraulic feed line 12. The bypass conduit 126 and the exhaust line 82 flow into a common return conduit 128 which returns the oil back to the oil reservoir 120. Since the constant flow pump 116 pumping capacity rate is relatively constant, e.g. 50 gal/min, the proportion of the oil that is bypassed through the bypass conduit 126 reglates the amount of oil which will enter the distributor valve 20. The flow rate through the bypass conduit 126 is controlled by a modulating control valve or throttle valve 130 that can be seen in cross section in FIG. 3. Basically, the modulating control valve 130 controls the flow area in the conduit 126 through the movement of a conical stem 132 which can be cammed for reciprocal movement through a ring seat 134.

The valve body 136 further supports a bias spring 138 which biases the conical stem 132 to the closed position disclosed in FIG. 3. A clevis 140 is attached to the conical valve stem 132 and supports a ballbearing follower or roller disclosed in phantom lines as element 142. The follower 142 engages a cam plate 144 which has an adjustable pivot point 146 on a motor crank arm 148. An electric modulating motor 150 controls the position of the cam plate 144. Either an operator would regulate the modulating motor 150 or it can be made part of a feed back system (not shown) responding to the power demands of the boiler 68.

Depending upon the particular fuel utilized in the boiler 68, various control functions can be further controlled by the modulating motor 150. For example, the control rod 152 can control the position of a damper blade 166 located in a supply air duct (not shown). In addition, the cam plate 144 can likewise control, by a fuel control valve 168, the gas flow on a gas fired boiler or the oil flow to an oil fired boiler in a manner similar to the modulating control valve 130 utilized to control the flow of hydraulic oil. Thus, the modulating motor 150 can replace a number of separate components that were necessary in the prior art for controlling the air, fuel and water flow. These functions are schematically disclosed in FIG. 1.

While it may be readily appreciated that the actual range of pump control can be infinite, the cam plate 144 is disclosed with a series of marked positions 154 that disclose a 5:1 ratio that is, from 20 percent to 100 percent having gradually variable flow rates of oil delivered to the pump 2. A relief valve 170 is capable of permitting a complete bypassing of oil from the constant deliver pump 116.

Referring again to FIG. 1, a reverse acting diaphragm pressure regulating valve 156 is positioned upstream of the modulating control valve 130. Basically, the pressure control valve 156 is designed to regulate the upstream hydraulic oil pressure delivered to the modulating control valve 130. This bypass pressure control valve 156 maintains a relatively constant pressure at the inlet of the modulating control valve 130 to assure constant flow characteristics through the valve 130. The pressure control valve 156 is similar to valve 70 but doesn't include any, bias springs. Control valve 156 has a diaphragm in communication with the downstream pressure from a self-regulating diaphragm pilot valve or pressure regulator valve 158.

The pilot valve 158 provides a constant pressure downstream of the valve 158. The particular arrangement of the pilot valve 158 permits only a pressure fluctuation of approximately 1 to 2 psi delivered to the modulating control valve.

If a spring was utilized to bias the pressure regulator 156 instead of the pilot valve 158 the fluctuations in pressure would be approximately 10 psi. The pilot valve line 160 passes approximately 1 gal/min of hydraulic fluid. A pilot control line 160 connecting the pilot valve 158 with the line 12 has a constant restrictor or bleed rate restrictor 162 to insure constant pilot valve downstream pressure and proper operation of the pressure control valve 156. A relief valve 164 in the pilot control line 160 protects the other valve components from excessive pressure.

Thus, during the operation of the hydraulic control system 144, the constant flow pump 116 provides a relatively constant flow of oil regardless of the hydraulic line pressure in hydraulic feed line 12. The bypass line 126 includes the pressure regulating valve 156 which is capable of providing a relatively constant hydraulic flow pressure at the inlet of the modulating control valve 130. A modulating motor 150 controls the bypass oil flow rate in by pass line 126 by regulating throttle valve 130 which in turn provides a corresponding proportionate control of the pumping rate of the diaphragm pump 2. The modulating motor 150 also is capable of controlling the air damper 166 and the fuel control valve 168 for the boiler furnace (not shown). Thus, for any position of the modulating control valve 130 there will be a corresponding bypass oil rate and therefore, a corresponding pumping water rate from the diaphragm pump 2. Since the hydraulic pumping capacity of pump 116 is constant; that is not seriously affected by the line pressure of the hydraulic feed line 12, the water rate will not be affected by pressure. Therefore, the water rate of the diaphragm pump 2 will be predictable and controllable for each position of the modulating control valve 130. The rate of oil flow in the hydraulic feed line 12 to the rotary distributor valve 20 is directly regulated by means of the bypass system. For example, if 50 percent of the hydraulic oil is bypassed, the remaining 50 percent will enter the distributor valve 20 and will drive the various diaphragm pump assemblies. The hydraulic diaphragm pump 2 will have a relatively smooth discharge flow as opposed to the pulsing discharge of the conventional reciprocating pump. This smoothness will be reflected in the feed water discharge side especially with the use of three or more diaphragm pump assemblies and check valve groups on the feed water side. The ports of the transfer passages 36 in the distributor valve 20 contribute to the smooth flow since they overlap and thereby provide for a continuous delivery and exhausting of hydraulic fluid to the diaphragm pump assemblies. Since the pump discharge will be relatively free from flow pulsations due to the pulsed phased relationship of the diaphragm pump assemblies, there will be no need of pulsation dampers in the feed water system discharge. Further, the use of a hydraulic control system 114 to control the feed water delivery system to the boiler 68 overcomes a principal weakness of pumping water directly; that is, the scoring of pistons and cylinders from contamination in the feed water such as sand and scale. The diaphragm pump assembly 2 and the various control components operate in a relatively clean hydraulic system that insures a longer life with less maintenance. Further, the hydraulic control system 114 eliminates the use of a large number of expensive components and thereby permits a more economical and efficient boiler feed water system.

While the preferred embodiment of the present invention has been disclosed, it should be recognized that various modifications would be apparent to an artisan skilled in the art and accordingly the scope of the invention should be determined solely from the following claims.

What is claimed is:

1. A feed water supply system for supplying water from a source to a boiler and the like comprising:

a source of hydraulic fluid;

means for pressurizing at least a portion of the hydraulic fluid;

a pumping apparatus driven by the hydraulic fluid and adapted to be connected to the source of water for supplying water to the boiler;

means for distributing the hydraulic fluid to and from the pumping apparatus including an exhaust line for the hydraulic fluid;

means for varying the rate of hydraulic fluid delivered to the pumping apparatus to control the pumping rate; and means for reducing any pressure surging of hydraulic fluid including means for varying the pressure of the exhausting hydraulic fluid from the pumping apparatus in the exhaust line in response to the pressure of the feed water.

2. The invention of claim 1 wherein the pumping apparatus includes at least one hydraulic fluid pressure actuating chamber having a cavity wall with an inlet port;

a pump chamber adapted to be connected to the source of water and the boiler; and a movable diaphragm separating the actuating chamber and the pump chamber for pumping the fluid having at least one projecting member extending from the diaphragm surface into and capable of contacting the hydraulic fluid pressure actuating chamber wall to further minimize any pressure surging of hydraulic fluid by preventing the diaphragm from sealing against the cavity wall.

3. The invention of claim 1 wherein the means for varying the pressure of the exhausting hydraulic fluid includes a pressure regulating valve connected to the source of water for varying the hydraulic exhaust pressure in response to variations of the water source pressure.

4. The invention of claim 1 wherein the means for varying the rate of hydraulic fluid delivered to the pumping apparatus includes a bypass conduit and a variable flow area valve in the bypass conduit.

5. The invention of claim 4 wherein the means for pressurizing at least a portion of the hydraulic fluid includes a constant displacement pump.

6. The invention of claim 5 wherein a pressure regulating valve is provided upstream of the variable flow area valve in the bypass conduit to provide a relatively constant pressure of hydraulic fluid entering the flow area valve.

7. The invention of claim 5 wherein the means for distributing the hydraulic fluid includes a constant speed rotating spool valve.

8. The invention of claim 2 wherein a plurality of projecting members are mounted on the surface of the diaphragm and extend into the actuating chamber.

9. The invention of claim 5 further including means for thermally insulating the diaphragm from the fluid being pumped.

10. A hydraulically actuated diaphragm pump comprising:

a housing;

at least one fluid pressure actuating chamber having a cavity wall with at least one inlet port in the housing;

a pumping chamber in the housing;

means for distributing a working fluid to and from the actuating chamber including a variable pressure control valve that regulates the exhausting pressure from the actuating chamber;

means for supplying a fluid to and from the pumping chamber;

a movable diaphragm separating the actuating chamber and the pumping chamber for pumping the fluid having at least one projecting member extending from the diaphragm surface and capable of contacting the fluid pressure actuating chamber to prevent the diaphragm from sealing against the cavity wall; and means for controlling the variable pressure control valve in response to the pressure of the fluid supplied to the pump chamber.

11. The invention of claim 10 wherein the means for distributing the working fluid to the actuating chamber includes a rotatable spool valve.

12. The invention of claim 10 further including means for thermally insulating the diaphragm from the fluid that is being pumped.

13. The invention of claim 10 wherein a plurality of projecting members are mounted on the surface of the diaphragm and extend into the actuating chamber.

14. The invention of claim 13 further including means for biasing the diaphragm towards the actuating chamber cavity wall.

15. The invention of claim 10 further including means for varying the pumping rate of the diaphragm.

16. The invention of claim 11 further including means for rotating the valve spool at a constant speed.

17. The invention of claim 15 wherein the means for varying the pumping rate includes a valve member for bypassing a portion of the working fluid delivered to the means for distributing the working fluid.

18. The invention of claim 14 wherein the surface of the diaphragm adjacent the pump chamber includes a projecting member forming a seat for locating the means for biasing the diaphragm.

19. The invention of claim 18 wherein the means for biasing includes a spring and a disk seating member, the disk seating member having on one side an indented surface complementarily to the diaphragm seat projecting member and on the other side a projecting hub for seating the spring.

20. A feed water supply system for supplying feed water to a boiler and the like comprising:

a source of hydraulic fluid;

means for pressurizing at least a portion of the hydraulic fluid;

pump means operatively connected to and driven by the hydraulic fluid for delivering feed water to the boiler;

bypass means for varying the rate of hydraulic fluid delivered to the pump means and accordingly varying the pumping output rate of the pump means; and means for controlling the hydraulic fluid pressure delivered to and exhausting from the pump means including means for varying the pressure of the exhausting hydraulic fluid in response to the pressure of the feed water, whereby pressure surging in the hydraulic fluid is controlled.

21. The invention of claim 20 wherein the pump means includes a housing having a cavity, a diaphragm member separates the cavity into a pumping chamber connected to the feed water and an actuating chamber connected to the hydraulic fluid.

22. The invention of claim 20 wherein the means for controlling the hydraulic fluid pressure includes a pressure regulator varying the exhausting hydraulic fluid pressure from the pump means in response to the feed water pressure entering the pump means.

23. The invention of claim 21 wherein the diaphragm member includes at least one projecting member extending into the actuating chamber for preventing the diaphragm from sealing against the housing cavity wall.

24. The invention of claim 23 wherein the bypass means includes a fluid conduit and means for regulating the pressure in the fluid conduit.

25. The invention of claim 24 wherein the means for regulating the pressure in the fluid conduit includes a pilot line and a first pressure regulator valve maintains a constant pressure in the pilot line.

26. The invention of claim 25 wherein the means for regulating the pressure includes a second pressure regulator connected to the pilot line and to the fluid conduit, the bypass means further includes a throttle valve downstream of the second pressure regulator.

27. A pumping assembly for supplying feed water to a boiler and the like when driven by a pressurized source of hydraulic fluid, comprising:

a housing;

at least one hydraulic fluid actuating chamber in the housing;

at least one pumping chamber in the housing;

a movable member separating the actuating chamber and the pump chamber for pumping the boiler water;

means for distributing the hydraulic fluid to and from the actuating chamber including an exhaust line for the hydraulic fluid;

means for supplying feed water to the pumping chamber including an inlet line for the feed water; and means for reducing any pressure surging of hydraulic fluid including means for varying the pressure of the exhausting hydraulic fluid from the actuating chamber in the exhausting line in response to the pressure of the feed water in the inlet line.

28. The invention of claim 27 wherein the means for reducing any pressure surging of hydraulic fluid further includes means for regulating the introduction of hydraulic fluid to the actuating chamber to prevent any sudden pressure surging movement of the movable member.

* * * * *